United States Patent [19]

Snide et al.

[11] Patent Number: 4,603,637

[45] Date of Patent: Aug. 5, 1986

[54] VARIABLE DENSITY FRANGIBLE PROJECTILE

[75] Inventors: James A. Snide; Edward J. Morrisey, both of Dayton, Ohio

[73] Assignee: The United States of America as represented by the Secretary of the Air Force, Washington, D.C.

[21] Appl. No.: 666,785

[22] Filed: Oct. 31, 1984

[51] Int. Cl.[4] ..... F42B 9/20

[52] U.S. Cl. ..... 102/529; 102/517

[58] Field of Search ..... 102/501, 444, 514–519, 102/529

[56] References Cited

U.S. PATENT DOCUMENTS

| | | | |
|---|---|---|---|
| 1,017,928 | 2/1912 | Tocik | 102/506 |
| 2,409,307 | 10/1946 | Patch et al. . | |
| 3,242,865 | 3/1966 | Jungermann et al. . | |
| 3,326,133 | 6/1967 | Stadler | 102/529 |
| 3,338,167 | 8/1967 | Jungermann et al. | 102/529 |
| 3,916,795 | 11/1975 | Lemstra | 102/529 |
| 4,165,692 | 8/1979 | Dufort . | |
| 4,466,330 | 8/1984 | Juretzek et al. | 102/529 |
| 4,517,898 | 5/1985 | Davis et al. | 102/517 |

FOREIGN PATENT DOCUMENTS

| | | | |
|---|---|---|---|
| 96617 | 12/1983 | European Pat. Off. | 102/529 |
| 1007227 | 10/1965 | United Kingdom | 102/501 |
| 1442072 | 7/1976 | United Kingdom . | |

*Primary Examiner*—Harold J. Tudor

*Attorney, Agent, or Firm*—Donald J. Singer; Charles E. Bricker

[57] ABSTRACT

A frangible projectile comprising a plurality of interfitting, filled polymeric portions is provided with controlled properties.

7 Claims, 1 Drawing Figure

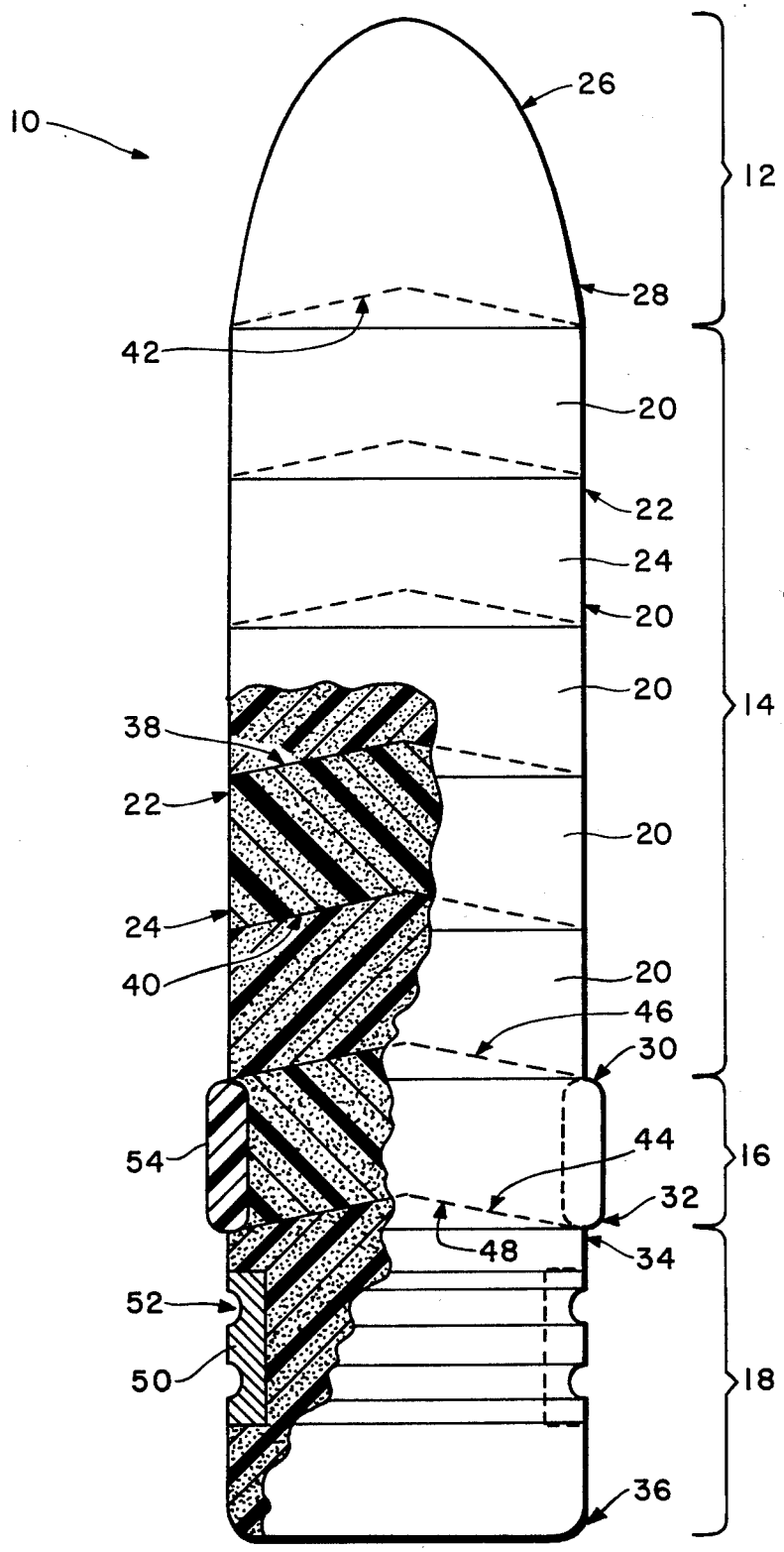
10
26
12
28
42
20
22
24
20
20
14
38
22
20
24
40
20
46
30
54
44
16
32
48
34
52
50
18
36

VARIABLE DENSITY FRANGIBLE PROJECTILE

RIGHTS OF THE GOVERNMENT

The invention described herein may be manufactured and used by or for the Government of the United States for all governmental purposes without the payment of any royalty.

BACKGROUND OF THE INVENTION

This invention relates to frangible projectiles for gunnery practice.

Practice training rounds are fired at paper/cloth targets for accuracy scoring as distinguished from combat rounds. To be useful in training, the practice rounds must reasonably duplicate the ballistics of the simulated combat round in terms of weight, location of the center of gravity, spin inertia and transverse inertia without increasing their cost. Additionally, it is desirable that ricochet hazards be minimized.

Ricochets can be suppressed by achieving breakup at impact. High drag fragments having a greatly reduced lethal range are needed as distinguished from high lethality fragments for combat rounds. Ricochet hazards are limited to high energy (mass and velocity) projectiles in contrast to small arms low energy projectiles.

It is an object of the present invention to provide a practice projectile which upon impact breaks apart into small fragments which will not travel far from the impact point.

Other objects, aspects and advantages of the present invention will be apparent to those skilled in the art from a reading of the following disclosure.

BRIEF DESCRIPTION OF THE DRAWING

In the drawing,

The FIGURE is a longitudinal view, partly in section of one embodiment of a shell according to the present invention.

DESCRIPTION OF THE PREFERRED EMBODIMENT

In the FIGURE the numeral 10 generally designates a frangible practice projectile. Projectile 10 comprises a nose portion 12, a forward body portion 14, an after body portion 16 and a base portion 18. The forward body portion 14 may consist of a plurality of cylindrical sections 20 each having a first end 22 and a second end 24. Alternatively, the forward body portion 14 may be a unitary module. Likewise, the nose portion 12 has a first end 26 and a second end 28, the after body portion 16 has a first end 30 and a second end 32, and the base portion 18 has a first end 34 and a second end 36.

Each of the various sections and portions includes alignment means for mating and alignment with the next adjacent portion or section. In the embodiment shown, the alignment means are outwardly conical at one end and inwardly conical at the other end. Thus, for example, each section 20 has a conical outward projection 38 at its first end 22 and a conical inward projection 40 at its second end 24. The nose portion 12 has a conical inward projection 42 at its second end 28; the base portion 18 has a conical outward projection 44 at its first end 34; and, the after body portion 16 has a conical outward projection 46 at its first end 30 and a conical inward projection 48 at its second end 32.

The base portion 18 includes means, such as metal crimp ring 50 having at least one outside circumferential crimping groove 52, for crimping a cartridge case, not shown, to the projectile 10.

The after body portion 16 has an outside diameter greater than the outside diameter of the portions 12, 14 and 18 to provide a seal between the projectile 10 and the bore of the weapon firing this projectile, including the rifling thereof. The greater outside diameter may be achieved by employing a separate band 54, as shown, or by fabricating the portion 16 to have a greater outside diameter.

The projectile 10 is made of at least one metal- or metal oxide-filled polymeric material, preferably a thermoplastic polymer, but at least a portion of the projectile 10 may be made of a thermosetting material. The base portion 18 is preferably made of a thermoplastic material which is tough and has a high resistance to impact and bending; polystyrene is preferred for this portion, although it may be made of polymethylmethacrylate, phenol formaldehyde resin, urea formaldehyde resin or the like. The nose portion 12, forward body portion 14 and after body portion 16 are made of a polymeric material which has a high tensile strength and ductility. Examples of suitable polymeric materials for these portions include polyethylene, polypropylene, polybutylene, polyvinyl chloride, polyvinyl acetate, polyvinyl alcohol, and the like.

The polymeric material is filled with a finely divided metal or metal oxide to achieve a desired density. The weight ratio of filler to polymer can range from about 1:4 to 4:1. Suitable fillers include lead, lead oxide, iron, iron oxide, copper, or the like.

For ease of manufacture, the various portions and sections of the projectile may be fabricated by injection molding, although other methods such as machining, pour molding followed by machining, or the like, may be employed. The various portions and sections are self-aligning and may be assembled using a simple "V" jig, followed by bonding, such as by induction welding, ultrasonic welding or adhesive bonding, of the various portions and sections. If a separate band 54 is employed in the after body portion 16, the band is installed thereon prior to assembling the next adjacent portions thereto. The band 54 is held to the body portion 16 by the same welding or bonding methods as above.

The filler, amount of filler and the polymeric material may be the same or different for the various portions and sections of the projectile, thus permitting selective control of mechanical, physical and thermal properties, and weight and balance of the projectile.

It is contemplated that the projectile of the present invention will be most useful for weapons in the 20–40 mm range, although larger and smaller projectiles may also be fabricated according to the invention.

Various modifications may be made to the present invention without departing from the spirit thereof or the scope of the appended claims.

We claim:

1. A frangible practice projectile comprising a nose portion, a forward body portion, an after body portion and a base portion, wherein each of said portions has a first end and a second end;

wherein the first end of said base portion, the first and second ends of each of said forward and after body portions and the second end of said nose portion include alignment means for mating and alignment with the next adjacent portion;

wherein each of said portions is bonded to the next adjacent portion;

wherein said after body portion has a first outside diameter and each of said base portion, forward body portion and nose portion has a second outside diameter, wherein said first outside diameter is greater than said second outside diameter;

wherein said base portion includes means for crimping a cartridge case thereto; and wherein said projectile is made of a filled polymeric material wherein the filler is a metallic material selected from the group consisting of metals and metal oxides.

2. The projectile of claim 1 wherein said alignment means consist of conical outward and complementary conical inward projections.

3. The projectile of claim 1 wherein said forward body portion consists of a plurality of cylindrical sections, wherein each section includes said alignment means.

4. The projectile of claim 1 wherein said base portion includes a metal band having at least one circumferential groove for crimping said cartridge case thereto.

5. The projectile of claim 1 wherein said polymeric material contains said metallic material in a weight ratio ranging from 1:4 to 4:1.

6. The projectile of claim 5 wherein the density of said polymeric material is uniform throughout said projectile.

7. The projectile of claim 5 wherein the density of at least one of said portions is different from at least one of the remaining of said portions.

* * * * *